US005927629A

United States Patent [19]

Dixon

[11] Patent Number: 5,927,629

[45] Date of Patent: Jul. 27, 1999

[54] ANTI-STATIC TENSION DEVICE

[76] Inventor: Tony Dixon, 2195 Elizabeth Ave., Rahway, N.J. 07095

[21] Appl. No.: 09/027,792

[22] Filed: Feb. 23, 1998

[51] Int. Cl.[6] ..... B65H 59/22; B65H 49/02; B65H 57/00

[52] U.S. Cl. ..... 242/150 R; 242/131.1; 242/157 R

[58] Field of Search ..... 242/150 R, 149, 242/157 R, 131.1

[56] References Cited

U.S. PATENT DOCUMENTS

| | | | |
|---|---|---|---|
| 2,373,066 | 4/1945 | Theiler | 242/131.1 X |
| 2,912,185 | 11/1959 | Vossen | 242/150 R |
| 3,181,569 | 5/1965 | Carroll | 242/150 R X |
| 3,304,027 | 2/1967 | Stanier | 242/150 R |
| 3,473,757 | 10/1969 | Cashore | 242/131.1 X |
| 4,378,096 | 3/1983 | Schnegg | 242/149 |
| 4,471,917 | 9/1984 | Whisnant | 242/131.1 X |
| 5,335,878 | 8/1994 | Jacobsson | 242/150 R |

OTHER PUBLICATIONS

Defence Publication, Patterson et al., Ser. No. 781088, Apr. 15, 1969.

*Primary Examiner*—Michael Mansen

*Attorney, Agent, or Firm*—Ezra Sutton

[57] ABSTRACT

An anti-static tension device for maintaining tension and drag on yarn and for reducing static on the yarn, as the yarn is supplied from a yarn bobbin supply to the creel of a knitting or weaving machine. The anti-static tension device includes a mounting clip for mounting the anti-static tension device on a creel; and an anti-static disc having a hole therein for receiving a collar. The collar has a first passageway for receiving yarn from a yarn bobbin supply, and the anti-static disc is formed of a non-static plastic material to reduce static on the yarn. The anti-static tension device further includes a tension assembly connected at one end to the mounting clip for mounting to a creel and at the other end thereof to the anti-static disc. The tension assembly includes a tension bracket, a needle shaft mounted on the tension bracket, the needle shaft having a second passageway formed therein in alignment with the first passageway and for receiving yarn, upper and lower tension discs mounted on the needle shaft and defining therebetween a pathway for receiving yarn in alignment with the first and second passageways. The tension assembly further includes a third passageway in alignment with the first and second passageways for receiving yarn and supplying it to the creel; and a gravity tension member for maintaining the upper and lower tension discs in contact with the yarn to maintain tension and drag on the yarn.

14 Claims, 6 Drawing Sheets

ANTI-STATIC TENSION DEVICE

FIELD OF INVENTION

This invention relates to an anti-static tension device for use with cones of high twisted yarn in the manufacture of knitted or weaved materials. More particularly, it relates to an anti-static tension device that feeds yarn to a knitting machine at a positive rate of speed without slippage; and as the yarn approaches the tension device, the anti-static disc prevents the yarn from being pulled towards the disc surface and prevents doubling up of the yarn as it feeds into the disc and tension assembly.

BACKGROUND OF INVENTION

In the knitting and weaving industry, there is a widespread dependence of overall quality in most textile processing on the precision and uniformity of tension of the individual yarn ends when weaving or knitting a fabric material. Once yarn tension control is lost or allowed to vary at any point of the process, whether winding, beaming, texturizing, knitting or other fabric formations, the quality degeneration is difficult or impossible to compensate for. Streaking, barre, off yield, excessive knitting defects, denier variation, are familiar problems that frequently have their origin in incorrect or uncontrolled tension of the individual yarn ends.

Probably the most common type of tension device in current use is the post and disc type tensioner wherein the yarn is routed around circular posts to generate friction and build tension. The advantage of this type of tensioner is its simplicity and low cost, but it has a significant disadvantage in that the tension developed by the wrapping depends on how much tension is in the yarn as it approaches the wrapped post. Since the tension in the yarn leaving such a tensioner is equal to the tension from the yarn source times a constant K determined by the wrap angle or number of posts, and the tension of the yarn going into the post and disc unit is usually uncontrolled, multiplying the supply or feed yarn tension by some factor simply makes the tension larger but still uncontrolled.

There remains a need for a durable, anti-static tension device for use with cones of high twisted yarn in the manufacture of knitted or weaved fabric materials, such that as yarn is fed to a knitting or weaving machine at a positive rate of speed, the tension device will prevent slippage of the feeding yarn; and as the yarn approaches the tension device, the anti-static disc will prevent the yarn from being pulled towards the outer disc surface and will also prevent the doubling-up of the yarn as it feeds into the anti-static disc and tension assembly.

DESCRIPTION OF THE PRIOR ART

Tension devices for intermittently tensioning yarn, as the yarn is fed to the knitting machine are well known in the art, and various designs, configurations, structures and materials of construction have been disclosed in the prior art. For example, U.S. Pat. No. 4,209,881 to Bore discloses a device for intermittently tensioning yarn passing therethrough to a knitting machine. The tensioning device includes a motor cam associated with a tension train mounted on a fixed shaft. The tension train includes a tension adjuster, a base plate, a helical spring and a pair of tension discs. The tension device functions such that yarn tension is adjusted to provide sufficient room for passage of yarn between the tension discs without stretching of the yarn as the yarn proceeds to the knitting machine. This prior art patent does not disclose the particular structure and design of the anti-static tension device of the present invention.

U.S. Pat. No. 5,191,847 to Kojima et al discloses a tension regulating device. The tension regulating device includes a tension regulating shaft fixed to a frame, a tension regulating dial rotation limit plate, a pair of tension discs attached to the shaft, a tension regulating spring and a regulating nut. This device can set an indicating value of tension for yarn or thread in the operation of a sewing machine. This prior art patent does not disclose the particular structure and design of the anti-static tension device of the present invention.

U.S. Pat. Nos. 4,462,557, 4,457,129 and 4,449,354, all being assigned to the Milliken Research Corporation of South Carolina, disclose an electromagnetically actuated disc tension control device, being a spring-biased type, a slotted disc type and a disc type for intermittently grasping and releasing a continuous filament of synthetic yarn which is being processed downstream of the tension control device. The tension disc apparatus includes an electromagnet, a spring biasing member, a pair of tension discs and a disc post having a slot. These prior art patents do not disclose the particular structure and design of the anti-static tension device of the present invention.

U.S. Pat. No. 5,611,499 to Stokes et al discloses a yarn tensioning device. The yarn tensioning device includes three pairs of spring loaded tensioning discs that exert an increasing incremental pressure on the yarn which correlates to the tension exerted in the yarn. This prior art patent does not disclose the particular structure and design of the anti-static tension device of the present invention.

The prior art also uses an anti-static tension device having a circular disc on one end having a circular disc diameter of about two inches. The disc does not prevent tangling of the yarn and does not reduce static since it is not made of an anti-static material.

None of the prior art patents teach or disclose the structure of the anti-static tension device of the present invention for eliminating or reducing yarn entanglement of the feeding yarn as it is supplied to the anti-static tension device from a yarn bobbin supply.

Accordingly, it is an object of the present invention to provide an anti-static tension device which guides yarn from a yarn cone to a knitting or weaving machine at a positive rate of speed without yarn slippage; and as the yarn engages the anti-static disc, the anti-static disc prevents the yarn from being pulled towards the outer disc surface and also prevents the doubling-up of the yarn as it feeds into the anti-static disc and tension assembly.

Another object of the present invention is to provide an anti-static tension device that is very durable, long-lasting, light-weight and to make the anti-static disc from an anti-static material to enhance its operation.

Another object of the present invention is to provide an anti-static tension device wherein the anti-static disc prevents the feeding yarn from fouling, twisting and tangling on the tension assembly of the anti-static tension device.

Another object of the present invention is to provide an anti-static tension device having a gravity tension member which will not push back the twist in the yarn as it is fed from the anti-static disc in operational use.

A further object of the present invention is to provide an anti-static tension device which can be mass produced in an automated and economical manner; and is readily affordable by the manufacturer of knitted or woven fabric materials.

SUMMARY OF THE INVENTION

In accordance with the present invention there is provided an anti-static tension device for maintaining tension and drag on yarn; and for reducing static on the yarn, as the yarn is supplied from a yarn bobbin supply to the creel of a knitting or weaving machine. The anti-static tension device includes a mounting clip for mounting the anti-static tension device on a creel; and an anti-static disc having a hole therein for receiving a collar. The collar has a first passageway for receiving yarn from a yarn bobbin supply, and the anti-static disc is formed of a non-static plastic material to reduce static on the yarn. The anti-static tension device further includes a tension assembly connected at one end to the mounting clip for mounting to the creel and at the other end thereof to the anti-static disc. The tension assembly includes a tension bracket, a needle shaft mounted on the tension bracket, the needle shaft having a second passageway formed therein in alignment with the first passageway and for receiving yarn, upper and lower tension discs mounted on the needle shaft and defining therebetween a pathway for receiving yarn in alignment with the first and second passageways. The tension assembly further includes a third passageway in alignment with the first and second passageways for receiving yarn and supplying it to the creel; and a gravity tension member for maintaining the upper and lower tension discs in contact with the yarn to maintain tension and drag on the yarn.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND ALTERNATE EMBODIMENTS

OVERVIEW

Figure 6:
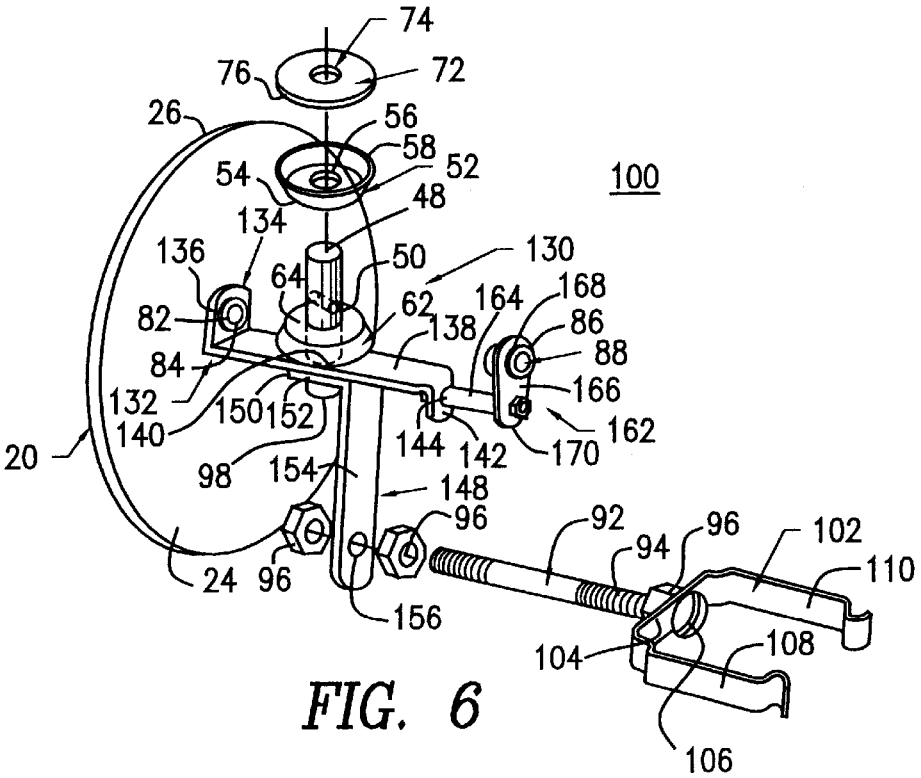
FIG. 6 is a partially exploded perspective view of the anti-static tension device of the preferred embodiment of the present invention showing the alternate tension assembly and the bracket extension member contained thereon.
Figure 7:
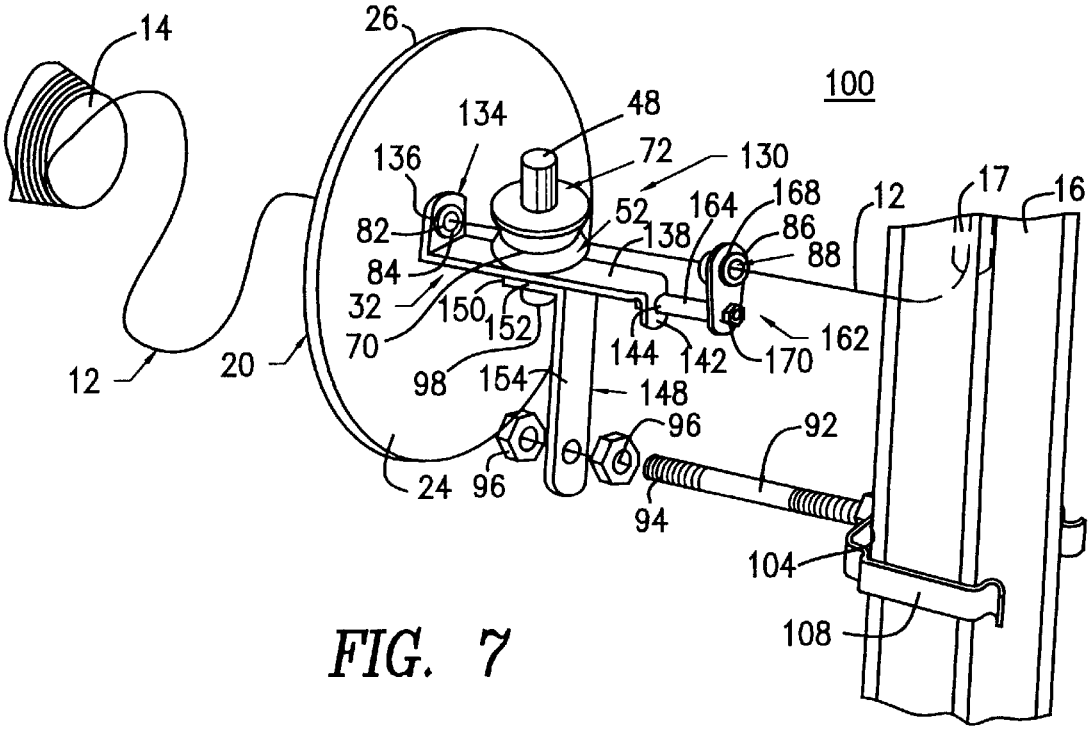
FIG. 7 is a perspective view of the anti-static tension device of the preferred embodiment of the present invention showing the alternate tension assembly and the bracket extension member contained thereon, and in operational use.

The anti-static tension devices 10, 100 and 200 of the preferred and alternate embodiments of the present invention are represented in detail by FIGS. 1 to 10 of the drawings. The anti-static tension devices 10 and 100 of the preferred embodiments are used for maintaining tension and drag on yarn 12, and for reducing static on the yarn 12, as the yarn 12 is supplied from a creel 16 to a knitting or weaving machine 18, as shown in FIGS. 1 through 7 of the drawings. The anti-static tension device 100, as shown in FIGS. 6 and 7, includes an alternate tension assembly 130 and a bracket extension member 162; and in all other respects the anti-static tension device 100 is the same as the anti-static tension device 10 of the preferred embodiment.

Figure 8:
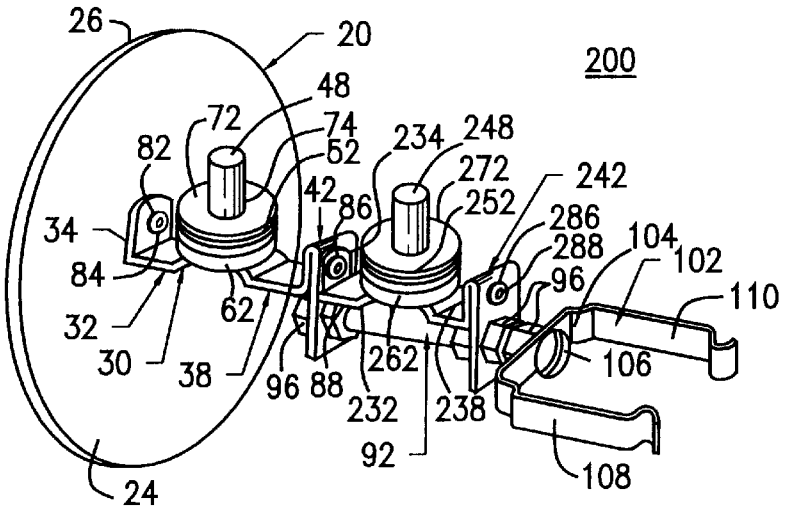
FIG. 8 is a perspective view of the anti-static tension device of the alternate embodiment of the present invention showing the major component parts contained thereon.
Figure 9:
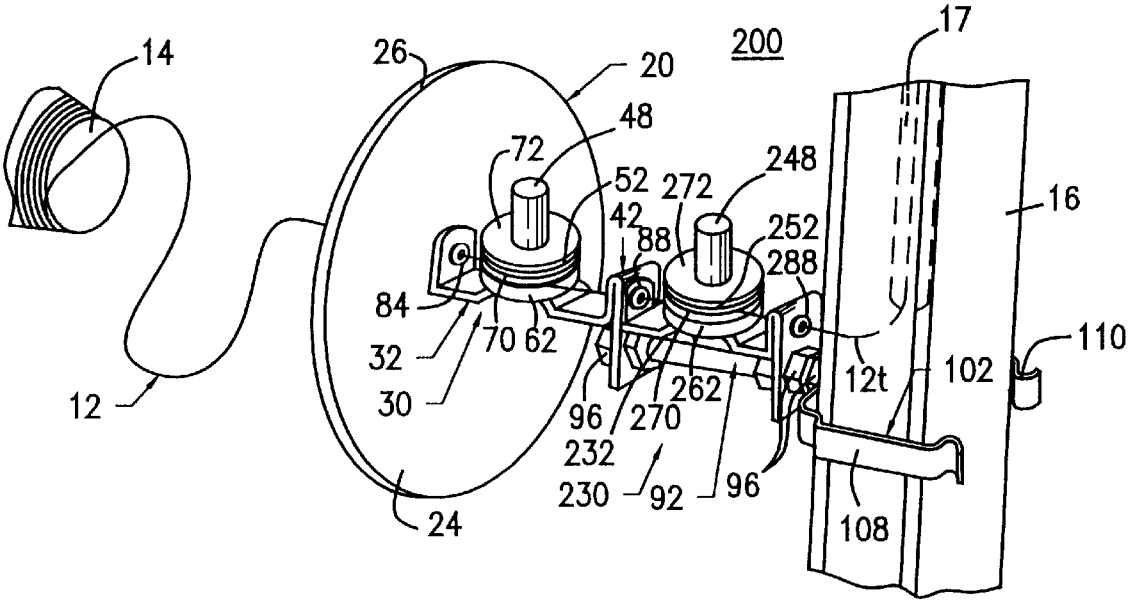
FIG. 9 is a perspective view of the anti-static tension device of the alternate embodiment of the present invention showing the major component parts contained thereon, and in operational use.
Figure 10:
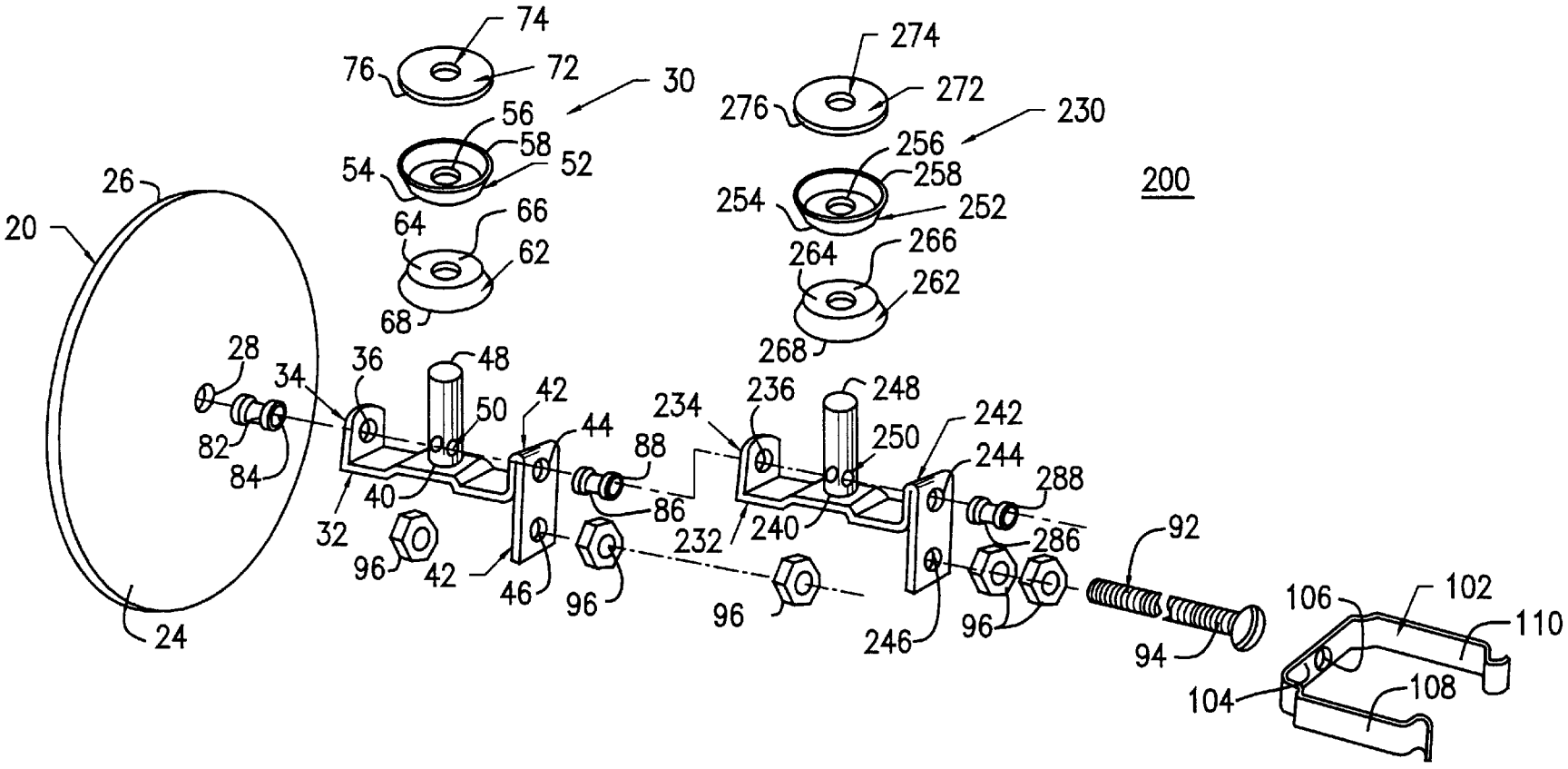
FIG. 10 is an exploded perspective view of the anti-static tension device of the alternate embodiment of the present invention showing the major component parts comprising the device.

The anti-static tension device 200 of the alternate embodiment is used for maintaining an increased tension and drag on yarn 12, and for reducing static on the yarn 12, as the yarn is supplied from a creel 16 to a knitting or weaving machine 18, as shown in FIGS. 8 through 10 of drawings. The anti-static tension device 200 of the alternate embodiment includes first and second tension assemblies 30 and 230; and in all other respects the anti-static tension 200 is the same as the anti-static tension device 10 of the preferred embodiment.

DETAILED DESCRIPTION OF THE PREFERRED EMBODIMENTS

Figure 1:
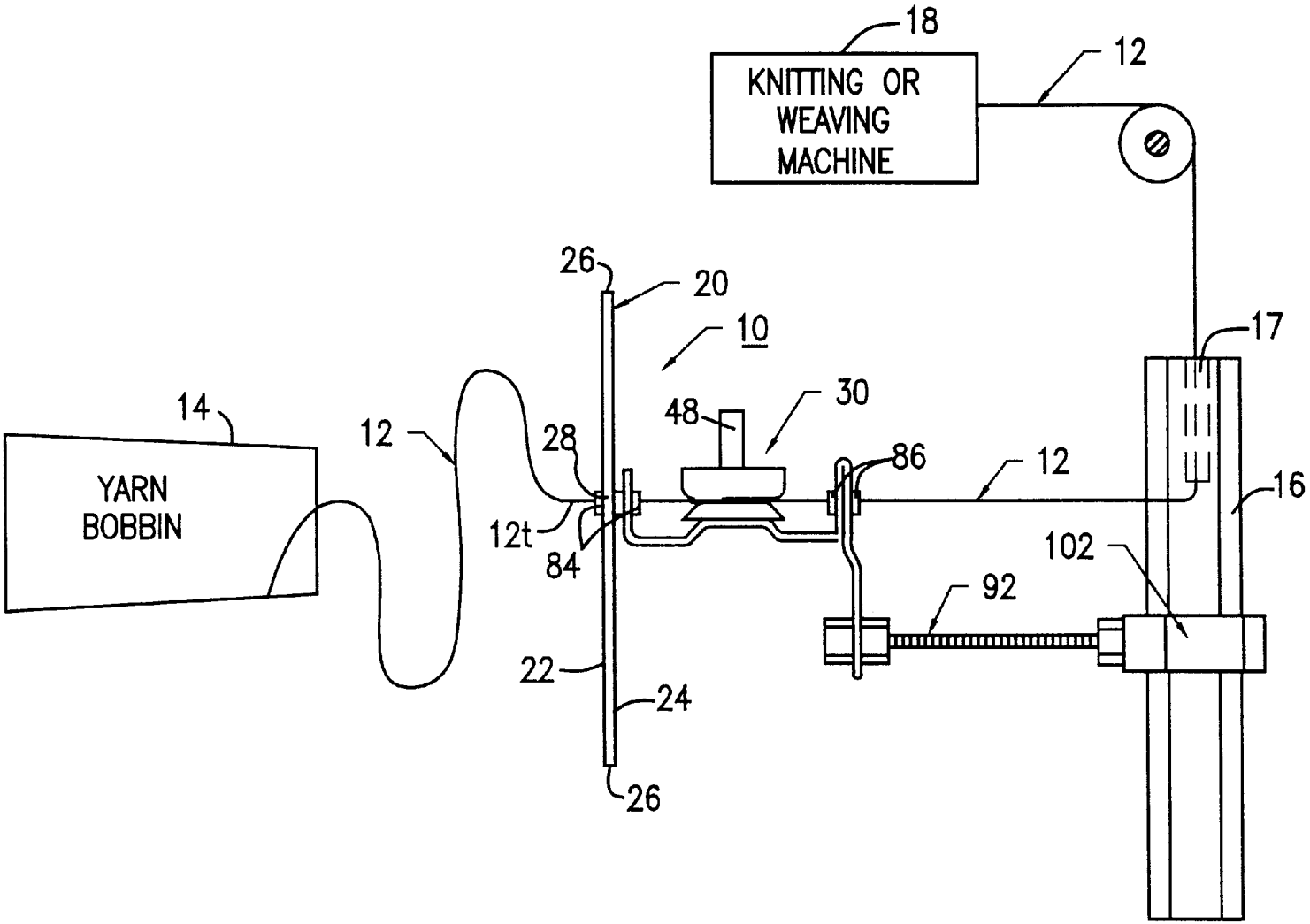
FIG. 1 is a diagrammatic overview of the anti-static tension device of the preferred embodiment of the present invention showing the location and placement of the tension device in relationship to the knitting machine.
Figure 2:
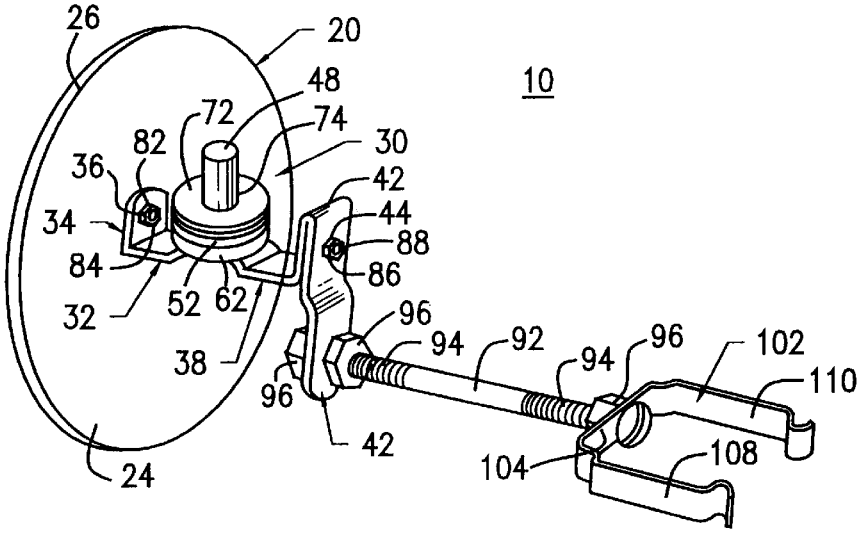
FIG. 2 is a perspective view of the anti-static tension device of the preferred embodiment of the present invention showing the major component parts contained thereon.
Figure 3:
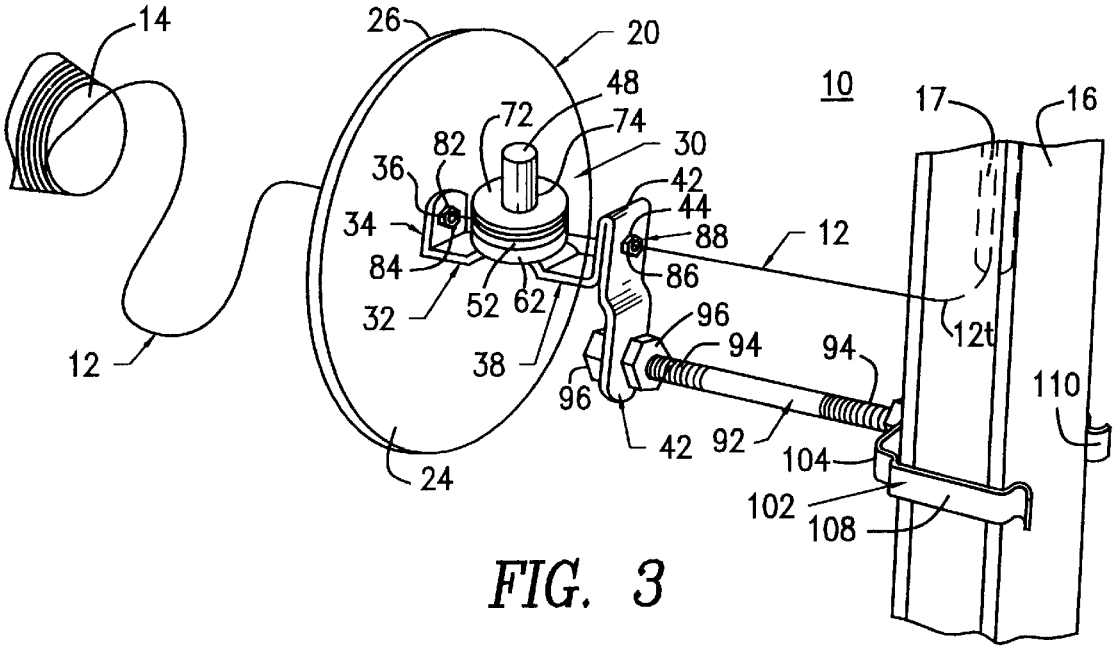
FIG. 3 is a perspective view of the anti-static tension device of the preferred embodiment of the present invention showing the major component parts contained thereon, and in operational use.
Figure 4:
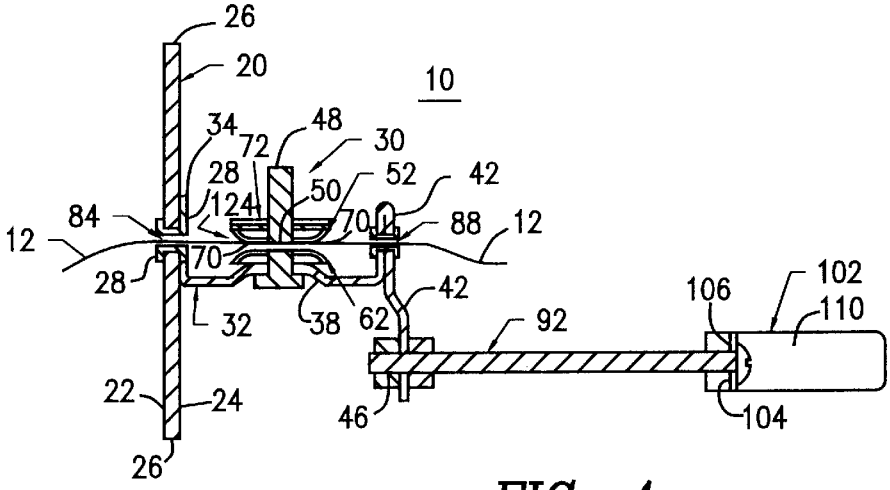
FIG. 4 is a cross-sectional view of the anti-static tension device of the present invention taken along lines 4—4 of FIG. 2 showing the anti-static disc, the tension assembly, the adjustment bolt and the creel gripping clip.
Figure 5:
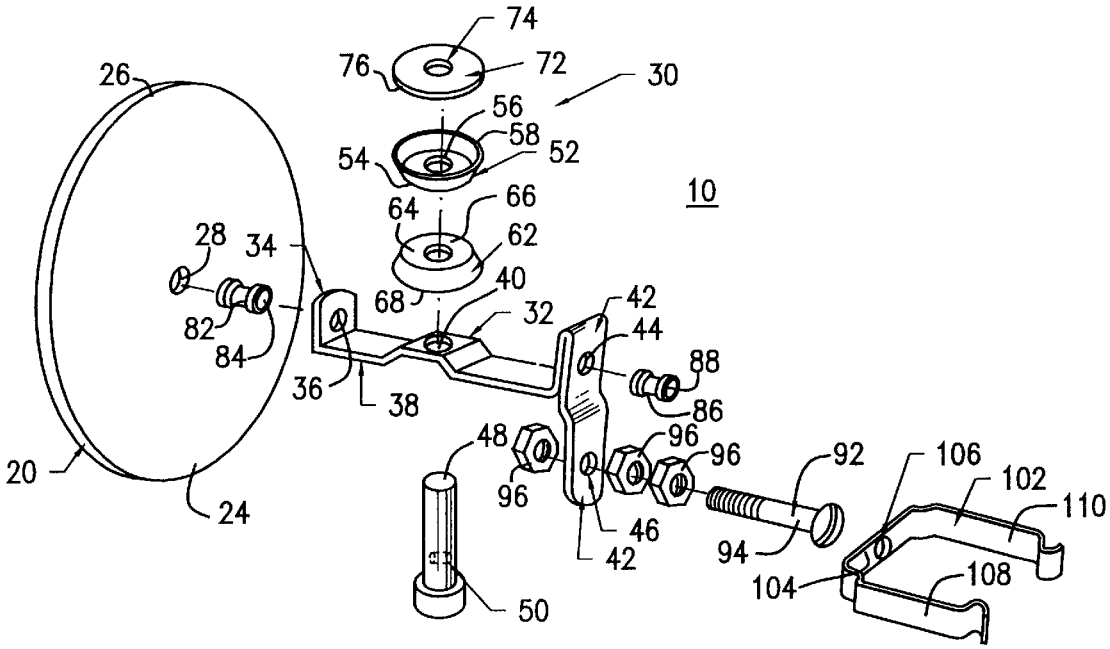
FIG. 5 is an exploded perspective view of the anti-static tension device of the preferred embodiment of the present invention showing the major component parts comprising the device.

The anti-static tension devices 10 and 100 and their component parts of the preferred embodiments of the present invention are represented in detail by FIGS. 1 through 6 of the drawings. The anti-static device 10, as shown in FIGS. 1 to 4, includes an anti-static disc 20; a tension assembly 30 having a tension bracket 32, a needle shaft 48 being mounted on the tension bracket 32, upper and lower tension discs 52 and 62 being mounted on the needle shaft 48, and a gravity tension member 72 on the needle shaft 48; a threaded adjustment bolt 92; and a gripping creel clip 102 for attachment to the creel framework 16. FIG. 3 in particular shows the yarn 12 from the yarn bobbin/cone supply 14 being fed through the anti-static tension device 10 to the creel framework 16.

The anti-static disc 20 includes front and rear wall surfaces 22 and 24, a circular peripheral edge 26 and a center hole or opening 28 for receiving a first insert collar 82. The anti-static disc 20 is formed of a non-static plastic material and is selected from the group consisting of acetyl compounds, polyacetylene compounds, polyethylene compounds, polyaniline compounds, polyvinyl chloride compounds, and urethane compounds. Examples of an acetyl compound for use as an anti-static disc 20 are DELRIN™ plastics, and PVC plastics. The anti-static disc 20 has a preferred diameter of five (5) inches, and a diameter range of four (4) inches to twenty (20) inches.

The tension bracket 32 of tension assembly 30 includes a first vertical wall 34 integrally attached to a horizontal wall 38 being integrally attached to a second vertical wall 42. The first vertical wall 34 includes a first upper hole or opening 36 for receiving the first insert collar 82 such that the rear wall surface 24 of anti-static disc 20 is adjacent to and in contact with the first vertical wall 34. The first insert collar 82 includes a first passageway 84 for receiving yarn 12 from the yarn bobbin supply 14. Horizontal wall 38 includes a centrally located hole opening 40 for receipt of the needle shaft 48 therein. Needle shaft 48 includes an eye opening 50 which defines a second passageway 50 for receiving yarn therethrough. The second passageway 50 is in alignment with the first passageway 84 and is aligned along a longitudinal axis of horizontal wall 38 of the tension bracket 32. The second vertical wall 42 includes a second upper hole opening 44 for receiving the second insert collar 86 and a lower hole opening 46 for receiving the threaded adjustment bolt 92 therein. The second insert collar 86 includes a third passageway 88 for receiving yarn 12 therein from the yarn bobbin supply 14. The third passageway 88 is in alignment with the first and second passageways 84 and 50, respectively, for receiving the yarn 12 and supplying the yarn 12 to the creel structure 16 thereon. Insert collars 82 and 86 are made of materials selected from the group consisting of anti-static plastics and ceramics.

The upper and lower tension discs 52 and 62 are mounted on the needle shaft 48 and define therebetween a yarn pathway 70 for receiving yarn 12 in alignment with the first and second passageways 84 and 50, respectively, as shown in FIG. 3 of the drawings. The upper tension disc 52 includes an upper yarn contact wall surface 54 having a center hole opening 56 for receiving needle shaft 48 therein, and an upper circular perimeter edging 58. The lower tension disc 62 includes a lower yarn contact wall surface 64 having a center hole opening 66 for receiving needle shaft 48 therein, and a lower circular perimeter edging 68. Perimeter edging 68 of lower tension disc 62 is adjacent to and in contact with the horizontal wall 38 of tension bracket 32, as shown in FIGS. 2 and 3 of the drawings.

The gravity tension member 72 is used for maintaining the upper and lower tension discs 52 and 62, respectively, in contact with the yarn in the yarn pathway 70, as shown in FIG. 3, in order to maintain tension and drag on the yarn 12 as it is supplied from the yarn bobbin supply 14. The gravity tension member 72 includes a center hole opening 74 for receiving the needle shaft 48 therein, and an inner wall surface 76. Inner wall surface 76 of gravity tension member 72 is adjacent to and in contact with the upper perimeter edging 58 of upper tension disc 52 in order to put weight/pressure on the yarn 12 via upper tension disc 52 for providing the proper tension and drag on the yarn 12 for preventing slippage of the feeding yarn as it feeds to the knitting or weaving machine 18. The gravity tension member 72 has a weight in the range of 10.0 mg to 10.0 g.

The threaded adjustment bolt 92 is used for adjusting and placing the anti-static tension device 10 at a proper location with respect to the yarn bobbin supply 14 and the creel structure 16; and for attaching the anti-static tension device 10 to the creel structure 16 via the gripping creel clip 102, as shown in FIGS. 1 and 3 of the drawings. Adjustment bolt 92 includes a threaded shaft 94 with a plurality of hex nuts 96 for adjusting the bolt 92 to a proper location with respect to the creel framework 16. Creel gripping clip 102 is substantially U-shaped and is made of a flexible metal or plastic. Creel gripping clip 102 includes a front wall 104 having a center hole or opening 106 for receiving adjustment bolt 92 therein, and integrally attached side walls 108 and 110 for attaching and gripping the creel structure 16 therewith, as shown in FIGS. 1 and 3 of the drawings.

The anti-static tension device 100 of the preferred embodiment, as shown in FIGS. 6 and 7, includes an alternate tension assembly 130 and a bracket extension member 160. Alternate tension assembly 130 includes a tension bracket 132 having a first vertical wall 134, a horizontal wall 138, and a second vertical wall 142 all being integrally attached thereto. In addition, tension bracket 132 further includes a third vertical wall 148 being L-shaped and having a top horizontal member 150 with a centrally located hole opening 152, and an integrally attached vertical member 154 with a lower hole opening 156 for receiving adjustment bolt 92 therein. The first vertical wall 134 includes an upper hole opening 136 for receiving the first insert collar 82 such that the rear wall surface 24 of anti-static disc 20 is adjacent and in contact with the first vertical wall 134. Horizontal wall 138 includes a centrally located hole opening 140. Hole openings 140 and 152 are aligned with each other for receiving the needle shaft 48 therein, and needle shaft 48 is held in place via a hex nut 98. The second vertical wall 142 includes a second lower hole opening 144 for receiving the bracket extension member 162.

The bracket extension member 162 includes a cylindrical horizontal member 164 connected to a vertical wall member 166 via a lower hole opening 170. Vertical wall member 166 also includes an upper hole opening 168 for receiving the second insert collar 86 therein. Hole opening 144 of vertical wall 142 receives end wall 172 of horizontal member 164 and hole opening 170 of vertical wall member 166 receives the other end wall 174 of horizontal member 164. As previously detailed, the third passageway 88 of the second insert collar 86 is in alignment with the first and second passageways 84 and 50 respectively, for receiving yarn 12 and supplying yarn 12 to the creel structure 16 thereon. In all other respects the anti-static tension device 100 is the same as the anti-static tension device 10 of the preferred embodiment.

DETAILED DESCRIPTION OF THE ALTERNATE EMBODIMENT 200

The anti-static tension device 200 of the alternate embodiment, as shown in FIGS. 8, 9 and 10, includes an anti-static disc 20; a first tension assembly 30; a second tension assembly 230; a threaded adjustment bolt 92; and a gripping creel clip 102 for attachment to the creel framework 16. Tension assembly 30 includes a tension bracket 32; a needle shaft 48 being mounted on the tension bracket 32; upper and lower tension discs 52 and 62 being mounted on the needle shaft 48, and a gravity tension member 72 on the needle shaft 48. FIG. 9 in particular shows the yarn 12 from the yarn bobbin supply 14 being fed through the anti-static tension device 200 to the creel framework 16.

The anti-static disc 20 includes front and rear wall surfaces 22 and 24, a circular peripheral edge 26 and a center hole or opening 28 for receiving a first insert collar 82. The anti-static disc 20 is formed of a non-static plastic material and is selected from the group consisting of acetyl compounds, polyacetylene compounds, polyethylene compounds, polyaniline compounds, polyvinyl chloride compounds, and urethane compounds. Examples of an acetyl compound for use in making an anti-static disc 20 are DELRIN™ plastics and PVC plastic. The anti-static disc 20 has a preferred diameter of five (5) inches, and a diameter range of four (4) inches to twenty (20) inches. The tension bracket 32 of tension assembly 30 includes a first vertical wall 34 integrally attached to a horizontal wall 38 being integrally attached to a second vertical wall 42. The first vertical wall 34 includes a first upper hole or opening 36 for receiving the first insert collar 82 such that the rear wall surface 24 of anti-static disc 20 is adjacent to and in contact with the first vertical wall 34. The first insert collar 82 includes a first passageway 84 for receiving yarn 12 from the yarn bobbin supply 14. Horizontal wall 38 includes a centrally located hole opening 40 for receipt of the needle shaft 48 therein. Needle shaft 48 includes an eye opening 50 which defines a second passageway 50 for receiving yarn therethrough. The second passageway 50 is in alignment with the first passageway 84 and is aligned along a longitudinal axis of horizontal wall 38 of the tension bracket 32. The second vertical wall 42 includes a second upper hole opening 44 for receiving of the second insert collar 86 and a lower hole opening 46 for receiving the threaded adjustment bolt 92 therein. The second insert collar 86 includes a third passageway 88 for receiving yarn 12 therein from the yarn bobbin supply 14. The third passageway 88 is in alignment with the first and second passageways 84 and 50, respectively, for receiving the yarn 12 and supplying the yarn 12 to the creel structure 16 thereon. Insert collars 82 and 86 are made of materials selected from the group consisting of anti-static plastics and ceramics.

The upper and lower tension discs 52 and 62 are mounted on the needle shaft 48 and define therebetween a yarn pathway 70 for receiving yarn 12 in alignment with the first and second passageways 84 and 50, respectively, as shown in FIG. 9 of the drawings. The upper tension disc 52 includes an upper yarn contact wall surface 54 having a center hole opening 56 for receiving needle shaft 48 therein, and an upper circular perimeter edging 58. The lower tension disc 62 includes a lower yarn contact wall surface 64 having a center hole or opening 66 for receiving of needle shaft 48 therein, and a lower circular perimeter edging 68. Perimeter edging 68 of lower tension disc 62 is adjacent to and in contact with the horizontal wall 38 of tension bracket 32, as shown in FIGS. 8 and 9 of the drawings.

The gravity tension member 72 is used for maintaining the upper and lower tension discs 52 and 62, respectively, in contact with the yarn in the yarn pathway 70, as shown in FIG. 9, in order to maintain tension and drag on the yarn 12 as it is supplied from the yarn bobbin supply 14. The gravity tension member 72 includes a center opening 74 for receiving the needle shaft 48 therein, and an inner wall surface 76. Inner wall surface 76 of gravity tension member 72 is adjacent to and in contact with the upper perimeter edging 58 of upper tension disc 52 in order to put weight/pressure on the yarn 12 via upper tension disc 52 for providing the proper tension and drag on the yarn 12 for preventing slippage of the feeding yarn as it feeds to the knitting or weaving machine 18. The gravity tension member 72 has a weight in the range of 10.0 mg to 10.0 g.

The anti-static device 200, as shown in FIGS. 8 to 10, further includes second tension assembly 230 having a tension bracket 232, a needle shaft 248 being mounted on the tension bracket 232, upper and lower tension disc 252 and 262 being mounted on the needle shaft 248, and a gravity tension member 272 on the needle shaft 248.

The tension bracket 232 of tension assembly 230 includes a first vertical wall 234 integrally attached to a horizontal wall 238 being integrally attached to a second vertical wall 242. The first vertical wall 234 includes a first upper hole or opening 236 for receiving the second insert collar 86 such that the second vertical wall 42 of tension bracket 32 is adjacent to and in contact with the first vertical wall 234 of tension bracket 232. The second insert collar 86 includes a third passageway 88 for receiving yarn from the yarn bobbin supply 14. Horizontal wall 238 includes a centrally located hole or opening 240 for receipt of the needle shaft 248 therein. Needle shaft 248 includes an eye opening 250 which defines a fourth passageway 250 for receiving yarn therein. The fourth passageway 250 is in alignment with the third passageway 88 and is aligned along a longitudinal axis of horizontal wall 238 of the tension bracket 232. The second vertical wall 242 includes a second upper hole opening 244 for receiving the third insert collar 286 and a lower hole opening 246 for receiving the threaded adjustment bolt 92 therein. The third insert collar 286 includes a fifth passageway 288 for receiving yarn 12 therethrough from the yarn bobbin supply 14. The fifth passageway 288 is in alignment with the first, second and third passageways 84, 50 and 88 respectively, for receiving the yarn 12 and supplying the yarn 12 to the creel structure 16 thereon. Insert collars 82, 86 and 286 are made of materials selected from the group consisting of anti-static plastics and ceramics.

The upper and lower tension discs 252 and 262 are mounted on the needle shaft 248 and define therebetween a yarn pathway 270 for receiving yarn 12 in alignment with the third and fourth passageways 88 and 250, respectively, as shown in FIG. 9 of the drawings. The upper tension disc 252 includes an upper yarn contact wall surface 254 having a center hole or opening 256 for receiving needle shaft 248 therein, and an upper circular perimeter edging 258. The lower tension disc 262 includes a lower yarn contact wall surface 264 having a center hole or opening 266 for receiving needle shaft 248 therein, and a lower circular perimeter edging 268. Perimeter edging 268 of lower tension disc 262 is adjacent to and in contact with the horizontal wall 238 of tension bracket 232, as shown in FIGS. 8 and 9 of the drawings.

The gravity tension member 272 is used for maintaining the upper and lower tension discs 252 and 262, respectively, in contact with the yarn 12 in the yarn pathway 270, as shown in FIG. 9, in order to maintain tension and drag on the yarn 12 as it is supplied from the yarn bobbin supply 14. The gravity tension member 272 includes a center hole or opening 274 for receiving the needle shaft 248 therein, and an inner wall surface 276. Inner wall surface 276 of gravity tension member 272 is adjacent to and in contact with the upper perimeter edging 258 of upper tension disc 252 in order to put weight/pressure on the yarn 12 via upper tension disc 252 for providing the proper tension and drag on the yarn 12 for preventing slippage of the feeding yarn as it feeds to the knitting or weaving machine 18. The gravity tension member 272 has a weight in the range of 10.0 mg to 10.0 g.

The threaded adjustment bolt 92 is used for adjusting and placing the anti-static tension device 200 at a proper location with respect to the yarn bobbin supply 14 and the creel structure 16; and for attaching the anti-static tension device 200 to the creel structure 16 via the gripping creel clip 102, as shown in FIGS. 8 and 9 of the drawings. Adjustment bolt 92 includes a threaded shaft 94 with a plurality of hex nuts 96 for adjusting the bolt 92 to a proper location with respect to the creel framework 16. Creel gripping clip 102 is substantially U-shaped and is made of a flexible metal or plastic. Creel gripping clip 102 includes a front wall 104 having a center hole or opening 106 for receiving adjustment bolt 92 therein, and integrally attached side walls 108 and 110 for attaching and gripping the creel structure 16 therewith, as shown in FIG. 9 of the drawings. In all other respects the anti-static tension device 200 performs and operates in the same manner as the anti-static tension device 10 of the preferred embodiment, except for the addition of the second tension assembly 230.

OPERATION OF THE PRESENT INVENTION

In operating the anti-static tension device 10, the operator places the front tip 12*t* of the yarn 12 form the yarn bobbin supply 14 into and through the first passageway 84 of the first insert collar 82, and then the front tip 12*t* of the yarn 12 is threaded into and through the second passageway 50 of needle shaft 48. The operator continues the threading process by inserting the front tip 12*t* of yarn 12 into and through the third passageway 88 of the second insert collar 86, and then the front tip 12*t* of the yarn 12 is fed into a length of plastic tube 17 which is attached to the creel structure 16, as shown in FIG. 3 of the drawings.

The operator next places the upper tension disc 52 on the needle shaft 48 via center opening 56, such that wall surface 54 is in contact with yarn 12, and then the operator places the gravity tension member 72 of a specific weight on the needle shaft 48 via center opening 74. Gravity tension member 72 is positioned such that the inner wall surface 76 of the gravity tension member 72 is adjacent to and in contact with the perimeter edge 58 of the upper tension disc 52. The gravity tension member 72 of a specific weight exerts a specific amount of tension and drag on the yarn 12 being fed through the anti-static tension device 10, as shown in FIG. 3 of the drawings. The weight of the gravity tension member 72 may vary depending upon the tensile strength of the yarn 12 being used to knit or weave a given fabric material. If the yarn 12 is made of a more delicate fiber, such as silk, less weight is needed for the gravity tension member 72, whereas if the yarn 12 is made of a more sturdy fiber, such as a nylon, more weight is needed for the gravity tension member 72 to provide a proper amount of tension and drag on the yarn 12 being supplied through the antistatic tension device 10.

As the yarn 12 is being fed off the yarn bobbin supply 14, the yarn 12 tends to oscillate and the anti-static disc 20 is of sufficient size, at least four inches in diameter, to prevent the yarn 12 from entangling itself on the disc 20 or tension assembly 30 when in operation. Additionally, as the yarn 12 approaches the tension device 10, the anti-static disc 20 prevents the yarn from being pulled towards the disc front wall surface 22 and thereby prevents doubling-up of the yarn 12 as it feeds into the first passageway 84 of insert collar 82 within anti-static disc 20 and tension assembly 30, thereby feeding the yarn 12 to a knitting or weaving machine 18 at a positive rate of speed without slippage.

Embodiments 100 and 200 operate in the same manner as embodiment 10 described above.

ADVANTAGES OF THE PRESENT INVENTION

Accordingly, an advantage of the present invention is that it provides for an anti-static tension device which guides yarn from a yarn cone to a knitting or weaving machine at a positive rate of speed without yarn slippage; and as the yarn engages the anti-static disc, the anti-static disc prevents the yarn from being pulled towards the outer disc surface and also prevents the doubling-up of the yarn as it feeds into the anti-static disc and tension assembly.

Another advantage of the present invention is that it provides for an anti-static tension device that is very durable, long-lasting, light-weight and to make the anti-static disc from an anti-static material to enhance its operation.

Another advantage of the present invention is that it provides an anti-static tension device wherein the anti-static disc prevents the feeding yarn from fouling, twisting and tangling on the tension assembly of the anti-static tension device.

Another advantage of the present invention is that it provides an anti-static tension device having a gravity tension member which will not push back the twist in the yarn as it is fed from the anti-static disc in operational use.

Another advantage of the present invention is that it provides an anti-static tension device which can be mass produced in an automated and economical manner; and is readily affordable by the manufacturer of knitted or woven fabric materials.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An anti-static tension device for maintaining tension and drag on yarn, and for reducing static on yarn, as the yarn is supplied from a yarn bobbin supply to the creel of a knitting or weaving machine, comprising:

a) means for mounting said anti-static tension device on a creel;

b) an anti-static disc having a hole therein for receiving a collar, said collar having a first passageway for receiving yarn from a yarn bobbin supply, and said anti-static disc being formed of a non-static plastic material to reduce static on the yarn;

c) a tension assembly connected at one end to said means for mounting; and said tension assembly connected at the other end thereof to said anti-static disc;

d) said tension assembly including a tension bracket, a needle shaft mounted on said tension bracket, said needle shaft having a second passageway formed therein in alignment with said first passageway and for receiving yarn, upper and lower tension discs mounted on said needle shaft and defining therebetween a pathway for receiving yarn in alignment with said first and second passageways;

e) said tension assembly including a third passageway in alignment with said first and second passageways for receiving yarn and supplying it to the creel;

f) means for maintaining said upper and lower tension discs in contact with said yarn to maintain tension and drag on said yarn;

g) said tension assembly further including adjustment means (92) for moving the center of said anti-static disc along an axis perpendicular to said anti-static disc to adjust the distance between the center of said anti-static disc and the creel in order to vary the tension and drag on the yarn; and h) said means for mounting said anti-static tension device on a creel includes a flexible gripping clip for adjusting the position of said anti-static tension device relative to the creel; said gripping clip also being attached to said adjustment means.

2. An anti-static tension device in accordance with claim 1, wherein said means for mounting include a gripping clip made of flexible metal or plastic.

3. An anti-static tension device in accordance with claim 1, wherein said means for maintaining tension on said yarn include a gravity tension member disposed on top of said upper tension disc.

4. An anti-static tension device in accordance with claim 3, wherein said gravity tension member has a weight in the range of 10.0 mg to 10.0 g.

5. An anti-static tension device in accordance with claim 1, wherein said anti-static disc is made of a non-static plastic material selected from the group consisting of acetyl compounds, polyacetylene compounds, polyethylene compounds, polyaniline compounds, polyvinyl chloride compounds, and urethane compounds.

6. An anti-static tension device in accordance with claim 1, wherein said collar is made of non-static plastic or ceramic.

7. An anti-static tension device in accordance with claim 1, wherein said anti-static disc includes a diameter measurement in the range of four (4) inches to twenty (20) inches.

8. An anti-static tension device in accordance with claim 7, wherein said anti-static disc includes a diameter measurement of five (5) inches.

9. An anti-static tension device in accordance with claim 1, wherein said tension assembly includes first and second vertical walls connected by a horizontal wall, said first vertical wall having said first passageway therein, said second vertical wall having said third passageway therein, and said horizontal wall including an opening for receiving said needle shaft therein.

10. An anti-static tension device in accordance with claim 1, further including a bracket extension member having a horizontal member and a vertical member; said vertical member having said third passageway in alignment with said first and second passageways.

11. An anti-static tension device in accordance with claim 1, wherein said adjustment means is an adjustment bolt.

12. An anti-static tension device for maintaining tension and drag on yarn, and for reducing static on the yarn, as the yarn is supplied from a yarn bobbin supply to the creel of a knitting or weaving machine, comprising:

a) means for mounting said anti-static tension device on a creel;

b) an anti-static disc having a hole therein for receiving a collar, said collar having a first passageway for receiving yarn from a yarn bobbin supply, and said anti-static disc being formed of a non-static plastic material to reduce static on the yarn;

c) first and second tension assemblies connected at one end thereof to said means for mounting; and said first and second tension assemblies connected at the other end thereof to said anti-static disc;

d) said first tension assembly including a first tension bracket, a first needle shaft mounted on said first tension bracket, said first needle shaft having a second passageway formed therein in alignment with said first passageway and for receiving yarn, a first set of upper and lower tension discs mounted on said first needle shaft and defining therebetween a first pathway for receiving yarn in alignment with said first and second passageways;

e) said first tension assembly including a third passageway in alignment with said first and second passageways for receiving yarn and supplying it to said second tension assembly;

f) said second tension assembly including a second tension bracket, a second needle shaft mounted on said second tension bracket, said second needle shaft having a fourth passageway formed therein in alignment with said first, second and third passageways and for receiving yarn, a second set of upper and lower tension discs mounted on said second needle shaft and defining therebetween a second pathway for receiving yarn in alignment with said first, second and third passageways;

g) said second tension assembly including a fifth passageway in alignment with said first, second, third and fourth passageways for receiving yarn and supplying it to the creel; and h) means for maintaining said first and second sets of upper and lower tension discs in contact with said yarn to maintain tension and drag on said yarn.

13. An anti-static tension device in accordance with claim 12, wherein said first and second tension assemblies further include adjustment means (92) for moving the center of said anti-static disc along an axis perpendicular to said anti-static disc to adjust the distance between the center of said anti-static disc and the creel in order to vary the tension and drag on the yarn.

14. An anti-static tension device in accordance with claim 13, wherein said means for mounting said anti-static tension device on a creel includes a flexible gripping clip for adjusting the position of said anti-static tension device relative to the creel; said gripping clip also being attached to said adjustment means.

* * * * *